US011854724B2

(12) United States Patent
Orimo et al.

(10) Patent No.: US 11,854,724 B2
(45) Date of Patent: Dec. 26, 2023

(54) METAL MAGNETIC POWDER AND METHOD FOR MANUFACTURING SAME, AS WELL AS COIL COMPONENT AND CIRCUIT BOARD

(71) Applicant: TAIYO YUDEN CO., LTD., Tokyo (JP)

(72) Inventors: Yoko Orimo, Takasaki (JP); Tomoo Kashiwa, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 161 days.

(21) Appl. No.: 17/370,800

(22) Filed: Jul. 8, 2021

(65) Prior Publication Data

US 2022/0037067 A1 Feb. 3, 2022

(30) Foreign Application Priority Data

Jul. 31, 2020 (JP) ..... 2020-130057

(51) Int. Cl.

| | |
|---|---|
| ***H01F 1/147*** | (2006.01) |
| ***C23C 8/14*** | (2006.01) |
| ***C22C 38/02*** | (2006.01) |
| ***C22C 38/18*** | (2006.01) |
| ***B22F 1/16*** | (2022.01) |
| ***B22F 1/142*** | (2022.01) |
| ***B22F 1/145*** | (2022.01) |
| ***C22C 38/00*** | (2006.01) |
| ***H01F 27/255*** | (2006.01) |
| ***H01F 17/04*** | (2006.01) |

(52) U.S. Cl.

CPC ..... *H01F 1/147* (2013.01); *B22F 1/142* (2022.01); *B22F 1/145* (2022.01); *B22F 1/16* (2022.01); *C22C 38/00* (2013.01); *C22C 38/02* (2013.01); *C22C 38/18* (2013.01); *C23C 8/14* (2013.01); *B22F 2301/35* (2013.01); *C22C 2202/02* (2013.01); *H01F 17/045* (2013.01); *H01F 27/255* (2013.01); *H01F 2017/048* (2013.01)

(58) Field of Classification Search

None

See application file for complete search history.

(56) References Cited

U.S. PATENT DOCUMENTS

2018/0200787 A1* 7/2018 Saito ..... B22F 1/12
2022/0005636 A1* 1/2022 Kawauchi ..... H01F 3/08

FOREIGN PATENT DOCUMENTS

JP 2015126047 A 7/2015
JP 2020070499 A * 5/2020 ..... B22F 1/0044

* cited by examiner

*Primary Examiner* — Xiaobei Wang
(74) *Attorney, Agent, or Firm* — Law Office of Katsuhiro Arai

(57) ABSTRACT

A metal magnetic powder is constituted by metal magnetic grains that each include: a metal phase where the mass percentage of Fe at its center part is lower than that at its contour part; and an oxide film covering the metal phase so as to allow the magnetic body resistant to magnetic saturation and low in iron loss.

9 Claims, 7 Drawing Sheets

Cross-Section A-A

METAL MAGNETIC POWDER AND METHOD FOR MANUFACTURING SAME, AS WELL AS COIL COMPONENT AND CIRCUIT BOARD

CROSS-REFERENCE TO RELATED APPLICATIONS

The present application claims priority to Japanese Patent Application No. 2020-130057, filed Jul. 31, 2020, the disclosure of which is incorporated herein by reference in its entirety including any and all particular combinations of the features disclosed therein.

BACKGROUND

Field of the Invention

The present invention relates to a metal magnetic powder and a method for manufacturing the same, as well as a coil component and a circuit board.

Description of the Related Art

In recent years, the drive for smaller, higher-performance mobile phones and other high-frequency communication systems is requiring electronic components installed therein to be also smaller and higher in performance. This is creating a demand for inductors and other coil components that are not only smaller in size, but also high in current flow. To achieve these requirements, metal magnetic materials that are more resistant to magnetic saturation than are ferrite materials are beginning to be adopted as the magnetic materials for use in coil components.

For example, Patent Literature 1 discloses using, as a metal magnetic material, a soft magnetic alloy powder having a composition of Fe-3.5% Si-4.0% Cr based on percent by mass (3.5 percent by weight of Si, 4.0 percent by weight of Cr, and Fe accounting for the remainder).

When using a metal magnetic material whose electrical insulating property is inferior to ferrite materials, oftentimes an insulating film is formed on the surface of the grains constituting the metal magnetic material for the purpose of improving its inferior electrical insulating property.

For example, Patent Literature 1 mentioned above discloses forming grains that will constitute a soft magnetic alloy powder by coating or depositing TEOS, colloidal silica, or other Si compound on their surface, and then heat-treating the grains in the air to cause them to bond together via insulating oxide layers.

BACKGROUND ART LITERATURES

[Patent Literature 1] Japanese Patent Laid-open No. 2015-126047

SUMMARY

An effective way to make a metal magnetic material resistant to magnetic saturation, that is, to increase its saturation magnetic flux density, is to increase its content percentage of Fe. This is why, in Patent Literature 1 mentioned above, a metal magnetic material whose content percentage of Fe exceeds 90 percent by mass is used.

However, increasing the content percentage of Fe in metal magnetic materials gives rise to a problem of higher iron loss. To address this problem, traditionally Si and other elements that can achieve an iron-loss reducing effect with relatively small quantities are contained in metal magnetic materials. However, this approach does not fundamentally solve the issue of trade-off between increasing the percentage of Fe to achieve high saturation magnetic flux density, and decreasing the percentage of Fe to achieve low iron loss, in metal magnetic materials.

Also, while the heat treatment to form oxide layers resulted in a slight increase in the percentage of Fe in the grains of the Fe—Si—Cr-based soft magnetic alloy powder in Patent Literature 1 mentioned above, how this affected the saturation magnetic flux density and iron loss is not clear.

Accordingly, an object of the present invention is to provide a metal magnetic powder that allows a magnetic body resistant to magnetic saturation and which is low in iron loss to be obtained.

Following the various studies conducted to solve the aforementioned problems, the inventor of the present invention found that the aforementioned problems could be solved by making sure the metal phase in the metal magnetic grains constituting the metal magnetic powder is such that the content percentage of Fe is low at the center part but high at the contour part near the surface, and consequently completed the present invention.

To be specific, the first aspect of the present invention to solve the aforementioned problems is a metal magnetic powder constituted by metal magnetic grains that each comprise: a metal phase where the mass percentage of Fe at its center part is lower than that at its contour part; and an oxide film covering the metal phase.

Additionally, the second aspect of the present invention is a method for manufacturing a metal magnetic powder, which includes: preparing a material powder for metal magnetic material whose Fe content is 90 to 99 percent by mass and which contains at least one type of metal element that oxidizes more easily than Fe in the air; placing the material powder in an atmosphere of 10 to 2000 ppm in oxygen concentration; and heat-treating the material powder in an atmosphere at a temperature of 400° C. or above but below 500° C. for at least 2 hours.

Additionally, the third aspect of the present invention is a coil component comprising: a magnetic body in which the metal magnetic grains constituting the metal magnetic powder pertaining to the aforementioned first aspect are joined together via a resin or oxide; and conductors placed inside, or on the surface of, the magnetic body.

Furthermore, the fourth aspect of the present invention is a circuit board on which the coil component pertaining to the aforementioned third aspect is installed.

According to the present invention, a metal magnetic powder can be provided that allows a magnetic body resistant to magnetic saturation and low in iron loss to be obtained.

BRIEF DESCRIPTION OF THE DRAWINGS

(FIG. 4A: General perspective view, FIG. 4B: View of cross-section A-A in FIG. 4A)

(FIG. 6A: General perspective view, FIG. 6B: View of cross-section B-B in FIG. 6A)

DESCRIPTION OF THE SYMBOLS

Figure 1:
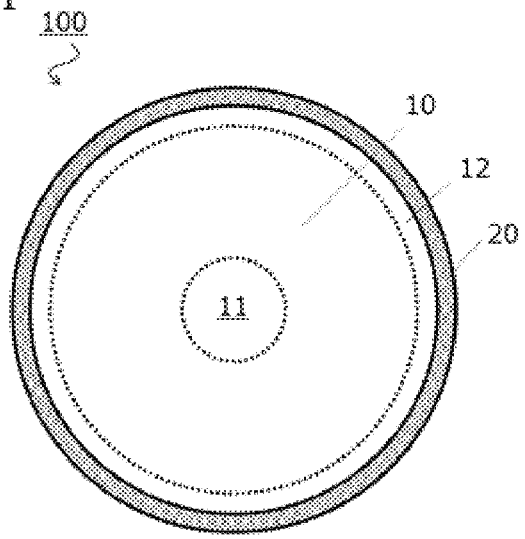
FIG. 1 is an explanatory drawing illustrating the cross-section structure of a metal magnetic grain constituting a metal magnetic powder pertaining to an aspect of the present invention.

100 Metal magnetic grain
10 Metal phase
11 Center part
12 Contour part
20 Oxide film
$E_1$, $E_2$ End point of analysis target line
L Length of analysis target line

DETAILED DESCRIPTION OF EMBODIMENTS

The constitutions as well as operations and effects of the present invention are explained below, together with the technical ideas, by referring to the drawings. It should be noted, however, that the mechanisms of operations include estimations and whether they are right or wrong does not limit the present invention in any way. Also, of the components in the aspects below, those not described in the claims representing the most generic concepts are explained as optional components. It should be noted that a description of numerical range (description of two values connected by "to") is interpreted to include the described values as the lower limit and the upper limit in some embodiments, and in other embodiments, the lower limit and/or the upper limit can be exclusive in the range.

[Metal Magnetic Powder]

The metal magnetic powder pertaining to the first aspect of the present invention (hereinafter also referred to simply as "first aspect") is constituted by metal magnetic grains that each comprise: a metal phase where the mass percentage of Fe at its center part is lower than that at its contour part; and an oxide film covering the metal phase.

As shown in FIG. 1, the metal magnetic grains 100 constituting the first aspect each comprise a metal phase 10 and an oxide film 20 formed on, and covering, the surface thereof. For the purpose of a composition analysis in a depth/radial direction of the metal phase 10 of the metal magnetic grain 100, the center part 11 and the contour part 12 are defined in an exemplary embodiment as follows: The center part 11 is a region extending radially from a center of the metal phase 10 outwardly to a radius of about 10% of the radius of the metal phase 10, and the contour part 12 is a region extending radially in depth from an outermost surface of the metal phase 10 to a depth of about 4% of the radius/depth of the metal phase 10.

The metal phase 10 has a center part 11 positioned near its center and a contour part 12 positioned immediately on the inner side of the oxide film 20. And, at the center part 11, the mass percentage of Fe relative to the contained metal elements is lower than the corresponding percentage at the contour part 12. Since, geometrically, the center part 11 of the metal phase 10 is where many magnetic fluxes will be passing through when a magnetic body is formed, a magnetic body low in iron loss can be obtained when the percentage of Fe at this part is low. On the other hand, geometrically, the contour part 12 of the metal phase 10 will have fewer magnetic fluxes passing through it than the center part 11; however, it will have high magnetic permeability due to a relatively high mass percentage of Fe, and therefore magnetic fluxes will easily flow in from the region on the inner side thereof. This means that more magnetic fluxes will be able to pass through the metal phase 10 and the magnetic saturation resistance will increase as a result, compared to when the same total quantity of contained Fe is evenly distributed across the metal phase 10. Hence, the metal magnetic powder, owing to the fact that the mass percentage of Fe is lower at its center part 11 than at its contour part 12, allows a magnetic body low in iron loss and resistant to magnetic saturation to be obtained. From the viewpoint of further increasing the iron-loss reducing effect, the aforementioned mass percentage of Fe at the center part 11 is preferably lower by at least 5 percent by mass, or more preferably lower by at least 10 percent by mass, than that at the contour part 12. Preferably the specific mass percentage of Fe at the center part 11 is 85 percent by mass or lower. On the other hand, from the viewpoint of minimizing the drop in magnetic properties due to a decrease in the mass percentage of Fe, preferably the mass percentage of Fe at the center part 11 is 80 percent by mass or higher. It should be noted that parts where the mass percentage of Fe is higher than at the center part 11 may exist in the depth direction beyond the contour part 12, spanning from the surface of the metal phase 10 and continuing throughout the inside of the metal magnetic grain 100.

Preferably the mass percentage of Fe at the contour part 12 is 98 percent by mass or higher. This way, the aforementioned action to inhibit magnetic saturation becomes significant.

In some embodiments, the center part and the contour part (and an intermediate part present therebetween) are not constituted by discrete layers having boundaries, and the metal phase is constituted by a single phase, wherein the mass percentage of Fe changes continuously in a radial direction. In other embodiments, the center part and the contour part (and an intermediate part present therebetween) are constituted by discrete layers having boundaries, and the metal phase is constituted by multiple phases, wherein the mass percentage of Fe changes discontinuously in a radial direction.

Here, the percentages of Fe at the center part 11 and contour part 12 are each determined by the method below. First, the metal magnetic powder is observed with a scanning transmission electron microscope (STEM) (JEM-2100F, manufactured by JEOL Ltd.) equipped with an annular dark-field (ADF) detector and an energy-dispersive X-ray spectroscopy (EDS) detector, to determine a view field containing multiple grains reflecting the granularity distribution of the powder. Here, "grains (in the view field) reflecting the granularity distribution of the (metal magnetic) powder" means eliminating those view fields that show grains all falling on the large grain size side, or on the small grain size side, of the granularity histogram and, so long as roughly equal numbers of grains falling on the large grain size side and grains falling on the small grain size side are contained in the view field (e.g., a number ratio of 4/6 to 6/4), the granularity distribution it represents may be slightly different (e.g., within ±30% as an average grain size) from the granularity distribution of the entire powder.

Next, the circle-equivalent diameter (Heywood diameter) is calculated for each of the metal magnetic grains 100 in the view field and the one having the largest diameter is selected as the observation target grain. It should be noted that, among the metal magnetic grains 100 in the view field, those having an extremely small grain size may be excluded from the candidates for the observation target grain and circle-equivalent diameter calculation may be omitted for these grains. Also, if the metal magnetic grain 100 having the largest diameter in the view field is immediately obvious, the observation target grain may be determined based on this fact and circle-equivalent diameter calculation and comparison may be omitted.

Next, on the observation target grain, a position of the metal phase 10 present on the inner side of the oxide film 20 is identified based on the contrast (brightness) difference in the observed cross-section. It should be noted that, under the present invention, the metal phase 10 is the part where the oxygen abundance ratio is 15 atomic percent or lower when analyzed by the aforementioned STEM-installed EDS, presenting a contrast that permits easy distinction from the oxide film 20 due to a difference in oxygen abundance ratio relative to the oxide film 20 which is an oxide and thus contains a large quantity of oxygen.

Figure 2:
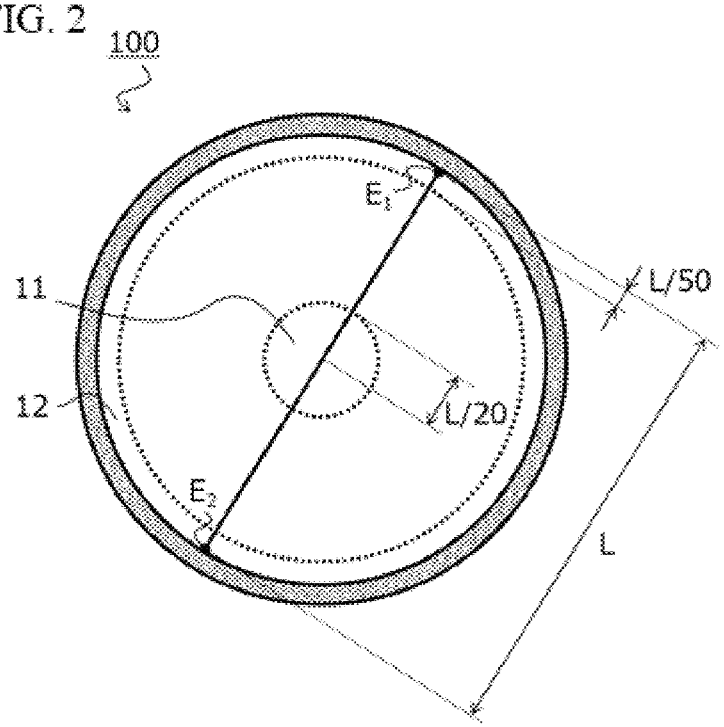
FIG. 2 is an explanatory drawing illustrating how to determine the center part, and the contour part, of the metal phase in a metal magnetic grain constituting a metal magnetic powder pertaining to an aspect of the present invention.

Next, on the identified metal phase 10, one arbitrary (randomly selected) point (point $E_1$) positioned at the boundary with the oxide film 20 is selected and, among the lines having this point as one end point and passing through the metal phase 10, the one with the largest length is determined as the analysis target line, as shown in FIG. 2. At this time, the other end point of the analysis target line is given as point $E_2$ and the length of the line, as L.

Next, the distributions of metal elements along the analysis target line are measured by line analysis to calculate the content percentage of each metal element.

Next, the range of L/20 each direction toward both end points from the midpoint (center point) of the analyzed line is defined as the center part 11 of the metal phase 10, as shown in FIG. 2, and the sum of the mass percentages of Fe at the respective measurement points within this region is divided by the number of the measurement points to calculate the average value, for use as the percentage (percent by mass) of Fe at the center part 11.

Also, the ranges of L/50 from both end points of the analyzed line are defined as the first contour part 12 (on a start-of-measurement end side) and the second contour part 12 (on an end-of-measurement end side) of the metal phase 10, respectively, as shown in FIG. 2, and the sum of the mass percentages of Fe at the respective measurement points within each of these regions is divided by the number of the measurement points to calculate the respective average values, for use as the percentage (percent by mass) of Fe at the first contour part 12 (on the start-of-measurement end side) and that at the second contour part 12 (on the end-of-measurement end side). Then, when the percentage (percent by mass) of Fe at the center part 11 is lower than both the percentages (percent by mass) of Fe at the two contour parts 12, the mass percentage of Fe at the center part 11 is considered lower than that at "the contour part 12". Also, when the content percentages (percent by mass) of Fe at the first as well as second contour parts 12, respectively, are different by a prescribed value or more from the corresponding percentage at the center part 11, the content percentage (percent by mass) of Fe at the center part 11 is considered lower by at least the prescribed value than at the contour part 12. When averaging the measurement points within each of the aforementioned regions, the average of five or more measurement points can be deemed a representative value of each such range. If the measured value at each measurement point is greater or smaller by 2 percent by mass or more (i.e., 2 percentage point or more) than the measured value at an adjacent measurement point, the average value of 10 or more measurement points can be used as a reliable representative value of each such range.

Preferably the distribution of Fe in the metal phase 10 is such that the average value of the mass percentages of Fe at the respective measurement points within the range of L/15 each direction toward both end points from the midpoint of the analysis target line is lower by at least 5 percent by mass than the corresponding percentage at the contour part 12, from the viewpoint of obtaining even lower iron loss. The aforementioned range extends more preferably by L/10 each direction, or even more preferably by L/8 each direction.

The elements contained in the metal phase 10 other than Fe are not limited so long as a metal magnetic powder, and a coil component, both having prescribed properties, can be obtained. However, preferably an element that oxidizes more easily than Fe in the air (hereinafter also referred to as "element M") is contained in the metal phase 10. This way, the effects of changes in the storage environment and use environment, particularly changes in temperature and humidity, are mitigated and the oxidation of Fe and drop in magnetic properties resulting therefrom will be effectively inhibited, which is desired. The oxidation inhibition action becomes significant when, for example, at least one type of element selected from Si, Cr, Al, Ti, Zr, and Mg is contained.

If at least one type of element selected from Si, Cr, Al, Ti, Zr, and Mg is contained in the metal phase 10, preferably it is at least present at the center part 11. This way, the electrical resistance of the center part 11 can be increased so that, when a magnetic body is formed, eddy current loss that would otherwise arise from the magnetic fluxes passing through it can be inhibited. Preferably the total of the percentages of these elements at the center part 11 is higher by at least 5 percent by mass than the total of such percentages at the contour part 12. This way, iron loss is effectively reduced. This action becomes more significant when the percentages of the aforementioned elements at the center part 11 amount to at least 10 percent by mass in total.

The oxide film 20 covering the metal phase 10 is not limited in composition, thickness, etc., so long as it can electrically insulate the metal phase 10 from other metal phase 10 when a coil component is manufactured using a metal magnetic powder containing the metal magnetic grains 100. The oxide film 20 normally contains element M. This way, the permeation of the oxygen in the oxide film 20, and oxidation of the constituent elements in the metal phase 10 resulting therefrom, will be inhibited. Preferably at least one type of element selected from Si, Cr, Al, Ti, Zr, and Mg is contained, for example, because this improves not only the aforementioned action of inhibiting oxidation of the constituent elements in the metal phase 10, but also the electrical insulating property of the oxide film 20. Additionally, when two or more types of elements M are contained in the oxide film 20, the metal magnetic powder will achieve higher electrical insulating property, while allowing a magnetic body offering excellent magnetic saturation properties to be obtained. When two or more types of elements M are contained in the oxide film 20, preferably Si is contained as one of them because the metal magnetic powder will have higher electrical insulating property exhibited by its oxide film 20.

Here, the elements contained in the oxide film 20 are identified according to the method below. First, an arbitrary metal magnetic grain 100 constituting the metal magnetic powder is measured for the content percentages (atomic percent) of iron (Fe), oxygen (O) and element M on its randomly selected surface using an X-ray photoelectron spectrometer (PHI Quantera II, manufactured by ULVAC-PHI, Inc.), followed by dry etching of the grain surface, and these steps are repeated to obtain the distribution of each element in the depth direction (diameter direction) of the grain. The content percentage of each element is measured using the monochromatized AlKα ray as the X-ray source, by setting the detection region to 100 μmϕ, and at depths incremented by 5 nm. Also, regarding the dry etching conditions, argon (Ar) is used as the dry etching gas, and the applied voltage is set to 2.0 kV and the dry etching rate, to approx. 5 nm/min (equivalent $SiO_2$ value).

Next, on the Fe concentration distribution (atomic percent) obtained by the measurement, the inter-measurement-point section where the concentration difference between the measurement points drops to below 1 atomic percent for the first time, as viewed from the grain surface side, is defined as the boundary between the metal phase 10 and the oxide film 20. It should be noted that, since the position of the boundary between the metal phase 10 and the oxide film 20 as determined by this method roughly matches the boundary determined by the analysis using the aforementioned STEM-installed EDS, either one may be adopted. If the two do not match, however, the result given by the aforementioned STEM-installed EDS is used as the boundary between the metal phase 10 and the oxide film 20 under the present invention.

Next, each measurement point positioned in the oxide film 20, which is a region shallower than the boundary, is checked for elements contained by a quantity (atomic percent) exceeding the detection limit. The above operation is performed on three different metal magnetic grains 100, and any element that has been confirmed to be contained in the oxide films 20 of all grains is determined as an element contained in the oxide films 20 of the metal magnetic grains 100 constituting the metal magnetic powder.

[Method for Manufacturing Metal Magnetic Powder]

The method for manufacturing a metal magnetic powder pertaining to the second aspect of the present invention (hereinafter also referred to simply as "second aspect") includes: preparing a material powder for metal magnetic material whose Fe content is 90 to 99 percent by mass and which contains at least one type of metal element that oxidizes more easily than Fe in the air; placing the material powder in an atmosphere of 10 to 2000 ppm in oxygen concentration; and heat-treating the material powder in the atmosphere at a temperature of 400° C. or above but below 500° C. for at least 2 hours.

The material powder contains 90 to 99 percent by mass of Fe, and also contains at least one type of element M. This causes Fe to diffuse toward the surface of the metal magnetic grain during the heat treatment described below, thereby increasing the mass percentage of Fe at the contour part, while lowering the mass percentage of Fe at the center part, of the metal phase. This way, the mass percentage of Fe can be varied at different positions inside the metal magnetic grain. As a result, metal magnetic grains are obtained which have a relatively low mass percentage of Fe at the center part, but a high mass percentage of Fe at the contour part, of their metal phase. And, this makes it possible to obtain, from the resulting metal magnetic powder, a magnetic body that offers low iron loss and which is resistant to magnetic saturation.

The material powder is placed in an atmosphere of 10 to 2000 ppm in oxygen concentration prior to the heat treatment described below, and remains in this atmosphere until the heat treatment is complete. Setting the oxygen concentration in the atmosphere to 10 ppm or higher increases the quantity of Fe that will oxidize at the metal magnetic grain surface during the heat treatment described below, which also increases the quantity of Fe that will diffuse from the inside, to the surface, of the metal magnetic grain. As a result, the mass percentage of Fe can be sufficiently decreased at the center part while the mass percentage of Fe can be increased at the contour part, in the metal phase. From the viewpoint of further increasing the difference in the mass percentage of Fe between the center part and the contour part, the oxygen concentration in the atmosphere is set preferably to 50 ppm or higher, or more preferably to 100 ppm or higher. On the other hand, setting the oxygen concentration in the atmosphere to 2000 ppm or lower can inhibit excessive oxidation of metal elements at the metal magnetic grain surface during the heat treatment described below. From the viewpoint of inhibiting the oxidation of metal elements to reduce the thickness of the oxide film to be formed on the metal magnetic grain surface, the oxygen concentration in the atmosphere is set preferably to 1000 ppm or lower, or more preferably to 500 ppm or lower.

The material powder is heat-treated for at least 2 hours at a temperature of 400° C. or above but below 500° C. Setting the heat treatment temperature at 400° C. or above activates the oxidation reaction of Fe at the metal magnetic grain surface, and consequently the quantity of Fe diffusing from the inside to the surface of the metal magnetic grain also increases. As a result, the mass percentage of Fe can be sufficiently decreased at the center part while the mass percentage of Fe can be increased at the contour part, in the metal phase. On the other hand, setting the heat treatment temperature to below 500° C. inhibits the oxidation reaction of element M at the metal magnetic grain surface, and consequent diffusion of element M from the inside to the surface of the metal magnetic grain. As a result, increase in the content percentage of Fe at the center part, and decrease in the content percentage of Fe at the contour part, can be avoided. As for the heat treatment time, setting it to at least 2 hours increases the quantity of Fe that will diffuse from the inside to the surface of the metal magnetic grain, so that the mass percentage of Fe can be sufficiently decreased at the center part while the mass percentage of Fe can be increased at the contour part, in the metal phase. The heat treatment time is preferably 5 hours or longer, or more preferably 10 hours or longer. Although the heat treatment time is not specifically limited at the upper end, it is set preferably to no longer than 24 hours, or more preferably to no longer than 16 hours, from the viewpoint of completing the treatment in a short period of time for improved productivity. It should be noted that the "heat treatment time" refers to the time during which the metal magnetic powder remains inside the aforementioned heat treatment temperature range. This means that, when the heat treatment temperature is changed within the aforementioned range, the heat treatment time represents the total of the times during which the metal magnetic powder is held at the respective temperatures.

While the rate of rise in temperature from room temperature to the aforementioned heat treatment temperature is not specifically limited, it is set preferably to 50° C./min or lower, or more preferably to 30° C./min or lower, or yet more preferably to 10° C./min or lower, from the viewpoint of reducing the load on the heat treatment device. On the other hand, from the viewpoint of shortening the temperature-raising time to complete the heat treatment in a shortened time period, the rate of rise in temperature is set preferably to 1° C./min or higher, or more preferably to 5° C./min or higher.

Once the prescribed heat treatment time elapses, heating is stopped and the metal magnetic powder is let cool as the heating device cools. An example of a cooling method is to lower the temperature inside the heating device to approx. 100° C. or below by means of furnace cooling, or specifically natural cooling that involves letting the heating device stand for a period of time, after which the atmosphere is returned to atmosphere to obtain a metal magnetic powder. Also, rapid cooling may be performed using the rapid cooling mechanism of the heating device in order to increase the rate of cooling and thereby shorten the manufacturing time. In this case, the rate of cooling is set to 150° C./min or higher between the heat treatment temperature and 200° C., for example.

The device with which to achieve the aforementioned atmosphere, rate of rise in temperature, heat treatment temperature, and heat treatment time is not limited, and a vacuum heat treatment furnace, atmosphere furnace, etc., may be used. Also, a rotary kiln furnace, etc., may be used to heat-treat the metal magnetic powder while causing its grains to flow, so as to prevent unwanted sticking or fusing between the metal magnetic grains constituting the metal magnetic powder.

[Coil Component]

The coil component pertaining to the third aspect of the present invention (hereinafter also referred to simply as "third aspect") comprises: a magnetic body in which the metal magnetic grains constituting the aforementioned first aspect are joined together via a resin or oxide; and conductors placed inside, or on the surface of, the magnetic body.

First, an embodiment of the third aspect is explained, which is a coil component comprising: a magnetic body in which the metal magnetic grains constituting the first aspect are joined together via a resin; and conductors placed inside, or on the surface of, the magnetic body.

In this embodiment, the metal magnetic grains forming the magnetic body have the same structure as the metal magnetic grains constituting the aforementioned first aspect, or specifically a structure of an oxide film covering a metal phase where the mass percentage of Fe at its center part is lower than that at its contour part. This allows the magnetic body to become resistant to magnetic saturation while low in iron loss, so that the coil component equipped with the magnetic body can carry larger current at the same dimensions or it can be made smaller while still carrying the same current.

The shape and dimensions of the magnetic body or material and shape of the conductors are not limited in any way, and may be determined as deemed appropriate according to the required properties.

Figure 3:
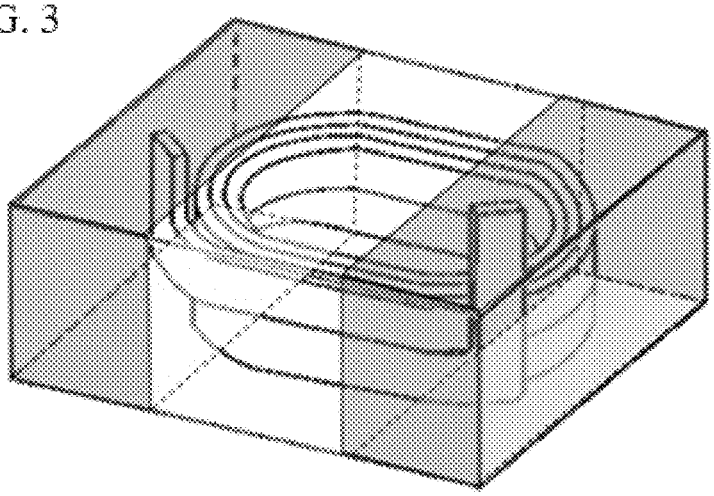
FIG. 3 is an explanatory drawing of a structural example of a composite coil component pertaining to an aspect of the present invention.
Figure 4A:
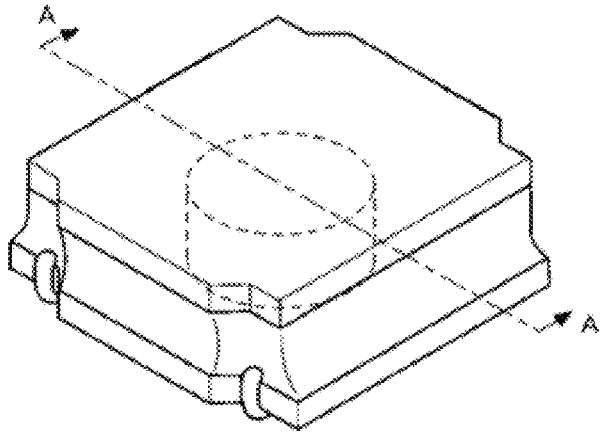
FIGS. 4A and 4B are explanatory drawings of a structural example of a wound coil component pertaining to an aspect of the present invention.
Figure 4B:
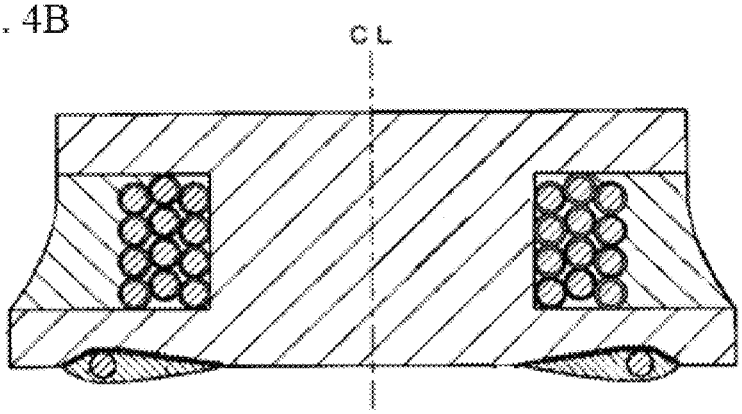
Figure 5:
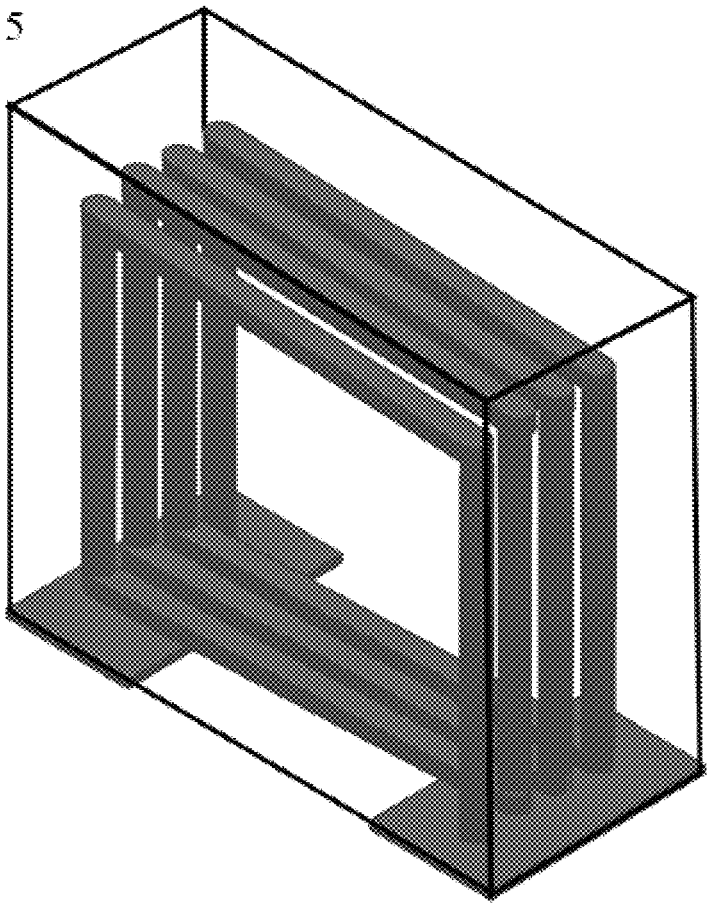
FIG. 5 is an explanatory drawing of a structural example of a thin-film coil component pertaining to an aspect of the present invention.

Embodiments of the third aspect include a composite coil component as shown in FIG. 3, a wound coil component as shown in FIGS. 4A and 4B, and a thin-film coil component as shown in FIG. 5, for example.

As for the method for manufacturing a coil component pertaining to any such embodiment, typically a composite coil component, for example, is obtained by mixing the metal magnetic powder pertaining to the first aspect with a resin to prepare a mixture, and then pouring the mixture into a die or other mold in which a hollow coil has been placed beforehand, followed by press-forming and curing of the resin.

The resin used is not limited in type so long as it can bond together the metal magnetic grains constituting the metal magnetic powder to form them into a shape and retain the shape, and epoxy resin, silicone resin, or any of various other resins may be used. The use quantity of the resin is not limited, either, and may be 1 to 10 parts by mass relative to 100 parts by mass of the metal magnetic powder, for example.

There is no limitation, either, on how the metal magnetic powder should be mixed with the resin and the mixture poured into the mold, and a method of kneading the two into a liquid mixture and then pouring it into the mold, or a method of pouring into the mold a granulated powder constituted by the metal magnetic grains whose surface has been coated with the resin, may be adopted, for example. Also, as a way of combining the pouring of the mixture into the mold with the press-forming described below, a method of forming the mixture into a sheet shape and then introducing it into the mold through a press, may be adopted.

The press-forming temperature and pressure are not limited, either, and may be determined as deemed appropriate according to the material and shape of the hollow coil placed inside the die, fluidity of the poured metal magnetic powder, type and quantity of the poured resin, and the like.

The temperature at which to cure the resin may also be determined as deemed appropriate according to the resin used. The resin may be cured under a general temperature condition, such as 150 to 300° C. At these temperatures, the composition of the metal magnetic powder pertaining to the first aspect hardly changes.

Also, when the third aspect is a wound coil component, it can be obtained by winding a coil around a magnetic body obtained by the same method used for the aforementioned composite coil component, except that the mixture is poured into the mold without placing a hollow coil in it.

Next, another embodiment of the third aspect is explained, which is a coil component comprising: a magnetic body in which the metal magnetic grains constituting the first aspect are joined together via an oxide; and conductors placed inside, or on the surface of, the magnetic body.

Figure 6A:
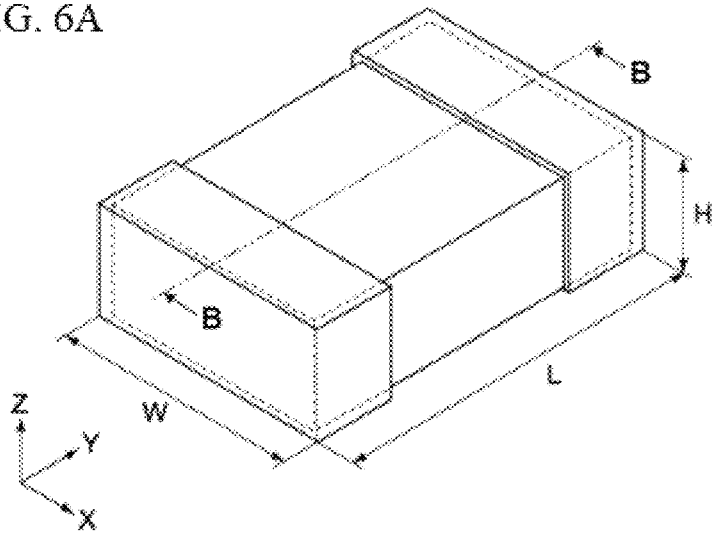
FIGS. 6A and 6B are explanatory drawings of a structural example of a multilayer coil component pertaining to an aspect of the present invention.
Figure 6B:
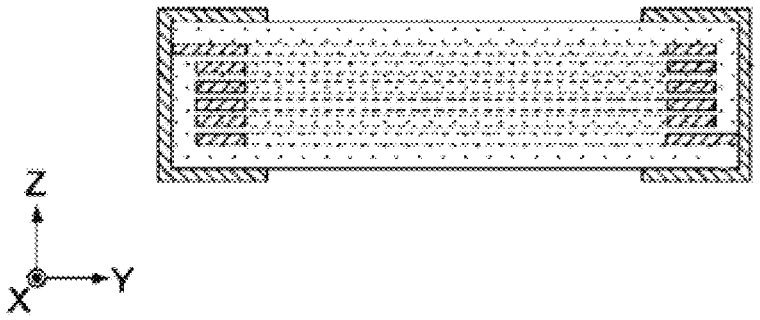

In this embodiment, the metal magnetic powder pertaining to the first aspect is formed and then heat-treated in the presence of oxygen to generate an oxide on the surface of the metal magnetic grains constituting the metal magnetic powder, so that the metal magnetic grains are joined together via the oxide into a magnetic body. In this case, preferably the heat treatment is performed in an atmosphere of 100 ppm or higher in oxygen concentration at a temperature of 600 to 800° C. with a duration of 30 minutes. Setting the heat treatment temperature for the compact higher than the heat treatment temperature of 400° C. or above but under 500° C. for the first aspect causes Fe contained in the oxide films on the metal magnetic grains in the compact to oxidize further to quickly generate an oxide where the oxide films are contacting each other, and the metal magnetic grains are quickly joined together via this oxide. As a result, the metal magnetic grains can be joined together even when the heat treatment time is short. On the other hand, a short heat treatment time means that the composition of the metal phase of the metal magnetic grain does not change significantly due to the heat treatment. Such coil component, too, can carry high current flow or permit size reduction as a result of the magnetic body being resistant to magnetic saturation and low in iron loss due to the presence of the metal phase which reflects the element distributions in the metal magnetic grains constituting the first aspect and has a low mass percentage of Fe at its center part and an extremely high corresponding percentage at its contour part. Such coil component may be, for example, a thin-film coil component as shown in FIG. 5, or a multilayer coil component as shown in FIGS. 6A and 6B, for example.

[Circuit Board]

The circuit board pertaining to the fourth aspect of the present invention (hereinafter also referred to simply as "fourth aspect") is a circuit board on which the coil component pertaining to the aforementioned third aspect is installed.

The circuit board is not limited in structure, etc., and any circuit board suitable for the purpose may be adopted.

The fourth aspect can demonstrate higher performance and permit size reduction by using the coil component pertaining to the third aspect.

EXAMPLES

The present invention is explained more specifically below using an example; however, the present invention is not limited to this example.

Example 1

(Manufacturing of Metal Magnetic Powder)

A material powder for metal magnetic material having an average grain size of 4 μm, as well as having a composition of 96.5 percent by mass of Fe, 2.5 percent by mass of Si, and 1 percent by mass of Cr, where the total of Fe, Si, and Cr represents 100 percent by mass, was placed in a vacuum heat treatment furnace. Next, the interior of the furnace was evacuated to an oxygen concentration of 100 ppm, after which the temperature was raised to 400° C. at a rate of rise in temperature of 5° C./min and then held for 3 hours to provide heat treatment, followed by furnace cooling to near room temperature, to obtain the metal magnetic powder pertaining to Example 1.

(Mass Percentage Measurement of Metal Elements in Metal Phase)

Figure 7:
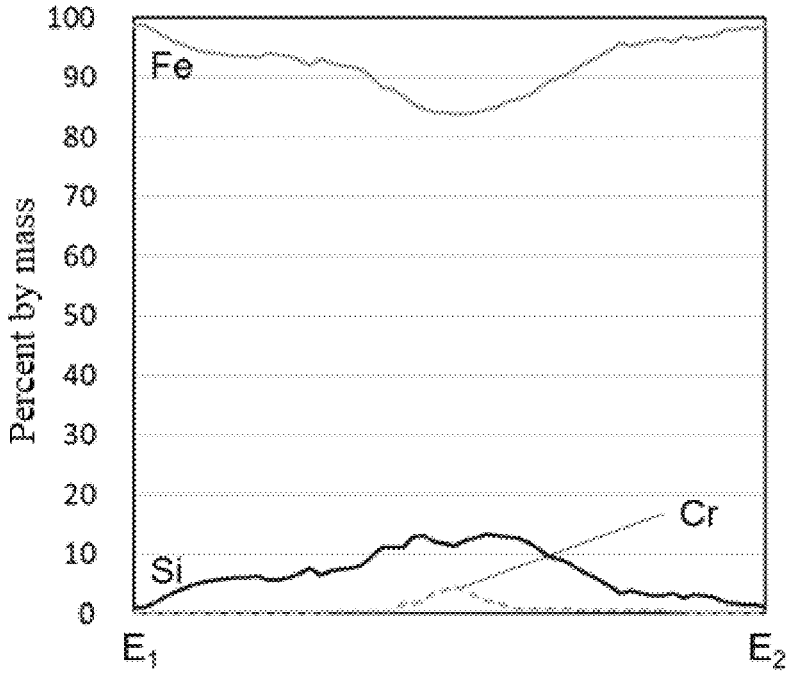
FIG. 7 is a graph obtained from line analysis of a cross-section of a metal magnetic grain constituting the metal magnetic powder pertaining to Example 1, showing the distributions of elements in the metal phase.

When the obtained metal magnetic powder was observed with a STEM according to the method described above, it was confirmed that the observation target grain had its metal phase covered with an oxide film. A line analysis was performed on this metal phase of the observation target grain according to the method described above, to calculate the content percentages of metal elements at each measurement point. The obtained results are shown in FIG. 7 as metal element distributions in the metal phase. Due to the view fields of the STEM, the figure presents the line analysis results in the respective view fields as continuous line analysis data. The positions along the horizontal axis in the figure correspond to the positions along the lines resulting from the line analysis, where "$E_1$" and "$E_2$" correspond to the positions denoted by the corresponding symbols in FIG. 2, or specifically the boundaries of the metal phase with the oxide film.

From the obtained metal element distributions, the mass percentages of each element at the center part and contour part of the metal phase were calculated according to the method described above. The mass percentage of Fe was 84.0 percent by mass at the center part and 98.9 percent by mass at the contour part, indicating that the percentage of Fe at the center part was lower than that at the contour part by 14.9 percent by mass. Also, Si and Cr were contained by 11.5 percent by mass and 4.5 percent by mass, respectively, at the center part, while Si and Cr were contained by 1.0 percent by mass and 0.1 percent by mass, respectively, at the contour part.

Comparative Example 1

The metal magnetic powder pertaining to Comparative Example 1 was obtained according to the same method used in Example 1, except that the heat treatment conditions were changed to raising the temperature to 800° C. at a rate of rise in temperature of 200° C./min and then holding it for 5 minutes.

Figure 8:
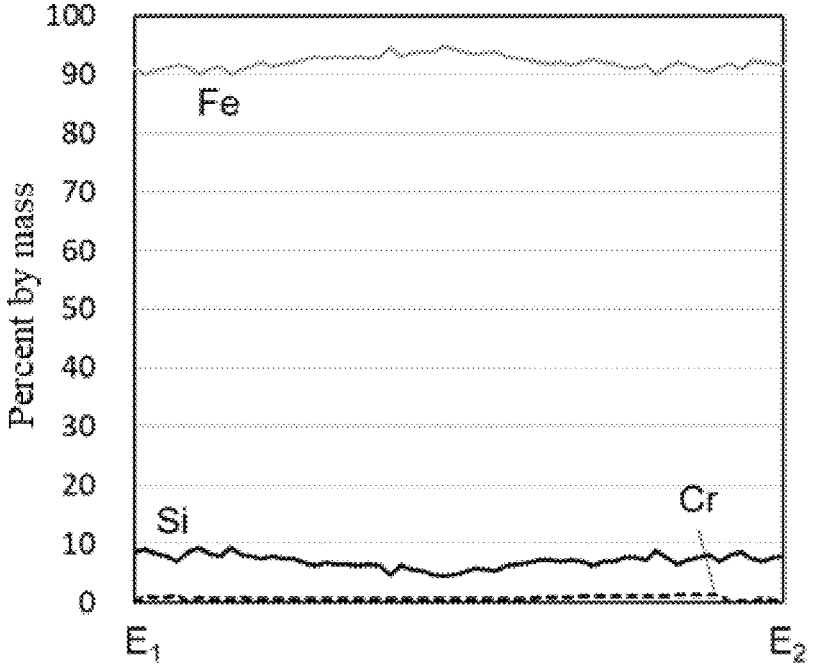
FIG. 8 is a graph obtained from line analysis of a cross-section of a metal magnetic grain constituting the metal magnetic powder pertaining to Comparative Example 1, showing the distributions of elements in the metal phase.

When this metal magnetic powder was observed with a STEM according to the same method used in Example 1, it was confirmed that the observation target grain had its metal phase covered with an oxide film. A line analysis was performed on this metal phase of the observation target grain according to the same method used in Example 1, to calculate the content percentages of metal elements at each measurement point. The obtained results are shown in FIG. 8 as metal element distributions in the metal phase.

From the obtained metal element distributions, the mass percentages of each element at the center part and contour part of the metal phase were calculated according to the same method used in Example 1. The mass percentage of Fe was 94.5 percent by mass at the center part and 90.8 percent by mass at the contour part, indicating that the percentage of Fe at the center part was higher than that at the contour part by 3.7 percent by mass. Also, Si and Cr were contained by 4.8 percent by mass and 0.7 percent by mass, respectively, at the center part, while Si and Cr were contained by 8.3 percent by mass and 0.9 percent by mass, respectively, at the contour part.

From these results, it is clear that heat-treating under specific conditions a material powder for metal magnetic material whose Fe content is 90 to 99 percent by mass and which contains at least one type of element M, allows metal magnetic grains to be formed that have a structure of an oxide film covering a metal phase whose contour part has a high percentage of Fe while center part has a relatively low percentage of Fe. A metal magnetic powder constituted by these metal magnetic grains allows a magnetic body resistant to magnetic saturation and low in iron loss to be obtained due to the aforementioned structure of the metal magnetic grains.

INDUSTRIAL APPLICABILITY

According to the present invention, a metal magnetic powder can be provided that allows a magnetic body resistant to magnetic saturation and low in iron loss to be obtained. The present invention is useful in that, by utilizing this powder, a magnetic body can be obtained that can carry high electrical current and also produces small energy loss during use, which in turn allows for higher performance or size reduction of a coil component comprising this magnetic body.

We claim:

1. A metal magnetic powder constituted by metal magnetic grains, each comprising:

a metal phase where a mass percentage of Fe at its center part is lower than that at its contour part; and an oxide film covering the metal phase.

2. The metal magnetic powder according to claim 1, wherein the percentage of Fe at the contour part is 98 percent by mass or higher.

3. The metal magnetic powder according to claim 1, wherein the percentage of Fe at the center part is lower by at least 5 percent by mass than that at the contour part.

4. The metal magnetic powder according to claim 1, wherein the percentage of Fe at the center part is 80 to 85 percent by mass.

5. The metal magnetic powder according to claim 1, wherein the metal phase further contains at least one type of element selected from Si, Cr, Al, Ti, Zr, and Mg.

6. The metal magnetic powder according to claim 5, wherein a total of percentages of Si, Cr, Al, Ti, Zr, and Mg at the center part is higher by at least 5 percent by mass than a total of corresponding percentages at the contour part.

7. The metal magnetic powder according to claim 6, wherein the percentages of Si, Cr, Al, Ti, Zr, and Mg at the center part amount to at least 10 percent by mass in total.

8. A coil component, comprising:

a magnetic body in which metal magnetic grains constituting a metal magnetic powder are joined together via a first oxide; and conductors placed inside, or on a surface of, the magnetic body, each metal magnetic grain comprising:

a metal phase where a mass percentage of Fe at its center part is lower than that at its contour part; and an oxide film, which is a second oxide, covering the metal phase.

9. A circuit board on which the coil component according to claim 8 is installed.

* * * * *